US007070168B2

(12) United States Patent
Plummer

(10) Patent No.: US 7,070,168 B2
(45) Date of Patent: Jul. 4, 2006

(54) CABLE PULLER ADAPTER

(75) Inventor: Jeffrey J. Plummer, Rockford, IL (US)

(73) Assignee: Greenlee Textron Inc., Rockford, IL (US)

( * ) Notice: Subject to any disclaimer, the term of this patent is extended or adjusted under 35 U.S.C. 154(b) by 35 days.

(21) Appl. No.: 10/658,692

(22) Filed: Sep. 9, 2003

(65) Prior Publication Data

US 2005/0051759 A1 Mar. 10, 2005

(51) Int. Cl.
*E21C 29/16* (2006.01)

(52) U.S. Cl. ..... 254/134.3 FT

(58) Field of Classification Search ..... 259/134.3 R, 259/134.3 FT
See application file for complete search history.

(56) References Cited

U.S. PATENT DOCUMENTS 3,072,382 A * 1/1963 Jones ..... 254/134.3 FT
3,224,733 A * 12/1965 Ensley ..... 254/134.3 R
4,456,225 A * 6/1984 Lucas ..... 254/134.3 FT

OTHER PUBLICATIONS

Greenlee Instruction Manual 6000-Series, Super Tugger Cable Pullers, © 2000 Greenlee Textron, 42 pages, Rev. 36, Dec. 2000.
Greenlee Instruction Manual 640-Series, Tugger Cable Pullers, © 2000 Greenlee Textron, 41 pages, Rev. 13, Dec. 2000.
Greenlee Instruction Manual, Ultra Tugger Cable Puller and Pulling Packages, © 2000 Greenlee Textron, 53 pages, Rev. 18, Dec. 2000.
"Operating, Maintenance, Safety and Parts Manual" for Current Tools Model 8890 and Model 8090, Fifty-one pages, Jun. 2003—Rev 0.
Brochure for Current Tools Mobile Cable Puller.

* cited by examiner

*Primary Examiner*—Robert C. Watson
(74) *Attorney, Agent, or Firm*—Trexler, Bushnell, Giangiorgi, Blackstone & Marr, Ltd.

(57) ABSTRACT

An assembly includes a cable puller, a wheeled carriage and an adapter mounted on the wheeled carriage. The cable puller has vise chains attached thereto. The adapter has a frame onto which the cable puller is mounted by the vise chains.

10 Claims, 12 Drawing Sheets

CABLE PULLER ADAPTER

BACKGROUND OF THE INVENTION

This invention is generally directed to an adapter for a wheeled carriage which allows a prior art cable puller to be mounted thereon. More particularly, the invention contemplates an adapter on which a prior art cable puller, namely the Greenlee Textron, Inc. 640-Series cable puller or the 6000-Series cable puller, can be mounted by use of vise chains which are provided as part of the prior art cable puller.

Cable pullers have been used for many years to pull cable during building construction. The cable puller must be secured directly to a structure or portable frame in order for the cable puller to be used. It is known in the prior art to mount the cable puller in a variety of ways. For example, the cable puller 20 can be mounted on an anchoring system 22 which is bolted to the floor as shown in FIG. 1, or mounted on an adapter 24 which is chain-mounted to a pipe 26 by vise chains 28 as is shown in FIG. 2, or on a T-stand 30 as shown in FIG. 3.

In addition, it is known in the prior art to mount a cable puller 20 on a wheeled carriage 32 by using pins 34 to mount the cable puller 20 to an adapter 36 which is in turn mounted to the wheeled carriage 32 by pins 38 as shown in FIGS. 4–6. The wheeled carriage 32 provides a distinct advantage over the floor anchoring system 22, the pipe-mounted adapter 24 or the T-stand 30 because the wheeled carriage 32 provides the ability for an operator to easily move the cable puller 20 around the building.

As shown in FIGS. 4–6, the wheeled carriage 32 is formed from a horizontal frame 40 onto which wheels 42 are mounted. A pair of spaced apart, upright posts 44 extend upwardly from the frame 40. A brace 46 extends upwardly from the frame 40 and connects between the posts 44. The brace 46 extends angularly from the frame 40.

The adapter 36 includes an L-shaped base 48, first and second spaced apart legs 50, 52 which extend perpendicularly from the base 48 and a boom receptacle 54 which extends outwardly from the base 48 in a direction opposite to the legs 50, 52. A boom tube 56 and associated nose unit 57 is secured to the boom receptacle 43 by suitable means, such as a set screw.

The adapter 36 is secured to the wheeled carriage 32 by the pins 38 which mount through aligned apertures in the first and second legs 50, 52 and in the posts 44. The cable puller 20 is mounted on the adapter 36 by the pins 34 which mount through aligned apertures in the cable puller 20 and the first and second legs 50, 52 of the adapter 36.

Some cable pullers 58, such as the Greenlee Textron, Inc. 640-Series cable puller and the 6000-Series cable puller, do not have the ability to be pin-mounted to a wheeled carriage. The Greenlee Textron, Inc. 6000-Series cable puller is shown in FIGS. 7 and 8. The 6000-Series cable puller 58 is mounted to a pipe, conduit or adapter 60 by vise chains 62 which are provided as part of the 6000-Series cable puller 58 as shown in FIGS. 9–11.

The 6000-Series cable puller 58 includes a housing 66, a motor 68 mounted to a first side of the housing 66 and a capstan 70 which extends from a second side of the housing 66. The housing 66 houses the components of the motor 68 that connect the motor 68 and the capstan 70 together such that the motor 68 rotates the capstan 70. A front base 72 is mounted on the underside of the front end of the housing 66 and extends outwardly from the housing 66 on both sides thereof. A rear base 74 is mounted on the underside of the rear end of the housing 66 and extends outwardly from the housing on both sides thereof. It is to be noted that FIGS. 10 and 11 shows only a base 72 of the cable puller 58 which has a vise chain 62 attached thereto. A first pair of spaced apart gripping feet 76 extend from an underside of the housing 66 and are aligned with the front base 72. A second pair of spaced apart gripping feet 78 extend from an underside of the housing 66 and are aligned with the rear base 74. An idler roller 80 is mounted on the rear base 74 rearwardly of the capstan 70. Each base 72, 74 has a threaded member 82 mounted on an end thereof which extends through an associated threaded aperture in the respective base 72, 74. Each vise chain 62 is attached to an end of the respective threaded member 82 on the underside of the respective base 72, 74. A handle 84 is attached to the other end of the threaded member 82. The vise chain 62 is formed from a plurality of links 86. Each link 86 has a pair of chain pins 88 which extend outwardly from each side of the link 86. The other end of each base 72, 74 has a cutout 90 therein into which the link 86 can be positioned. The cutout 90 has a pair of pockets 92 on either side thereof which accepts the pins 88 provided on the link 86 when the link 86 is mounted therein.

In use, the gripping feet 76, 78 are placed against the pipe, conduit or adapter 60. The handles 84 are rotated to expose most of the threads which connects the handle 84 to the housing 66 of the cable puller 58. The vise chains 62 are wrapped around the pipe, conduit or adapter 60; the vise chains 62 are pulled tight; and the chain pins 88 are inserted into the pockets 92. Thereafter, the handles 84 are turned, by hand, to fully tighten the vise chains 62 against the pipe, conduit or adapter 60.

The 640-Series cable puller is mounted in the same manner as the 6000-Series cable puller.

Because the structure of the wheeled carriage 32 is only designed to accept a pin-mounted cable puller 20, the wheeled carriage 32 is not adaptable to mount the chain-mounted cable puller 58 thereto. As a result, the advantage provided by the wheeled carriage 32 has not heretofore been provided for the chain-mounted cable puller 58. The present invention provides an adapter for mounting a chain-mounted cable puller 58 onto a wheeled carriage 32. Other features and advantages of the present invention will become clear upon a reading of the attached specification in combination with a study of the drawings.

OBJECTS AND SUMMARY OF THE INVENTION

A general object of the present invention is to provide an adapter for a wheeled carriage onto which a prior art cable puller can be mounted.

An object of the present invention is to provide an adapter on which a prior art cable puller, namely the Greenlee Textron, Inc. 640-Series cable puller or the 6000-Series cable puller, can be mounted by use of vise chains which are provided as part of the prior art cable puller.

Another object of the present invention is to provide an adapter onto which a cable puller can be mounted which provides for easy side loading of rope into the cable pulling system.

Briefly, and in accordance with the foregoing, the present invention discloses an assembly which includes a cable puller, a wheeled carriage and an adapter mounted on the wheeled carriage. The cable puller is formed in accordance with the prior art and has vise chains attached thereto. The adapter has a frame onto which the cable puller is mounted by the vise chains.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIGS. 17 and 18 are side elevational view of the cable pulling system of FIG. 12 shown in two different angled positions.

DETAILED DESCRIPTION OF THE ILLUSTRATED EMBODIMENT

Figure 1:
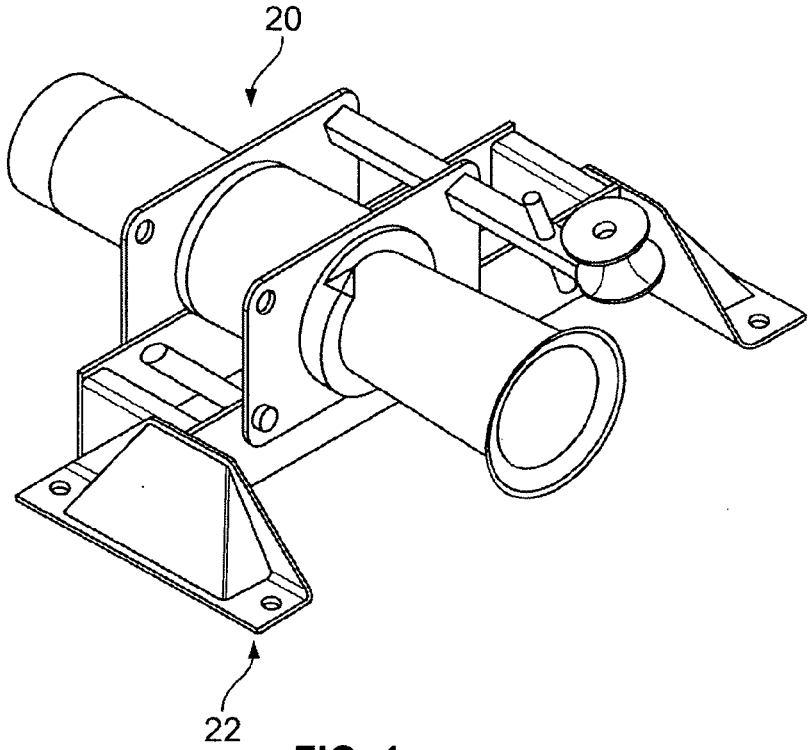
FIG. 1 (Prior Art)
FIGS. 1–4 are perspective views of a prior art cable puller mounted on different types of prior art mounting system.
Figure 2:
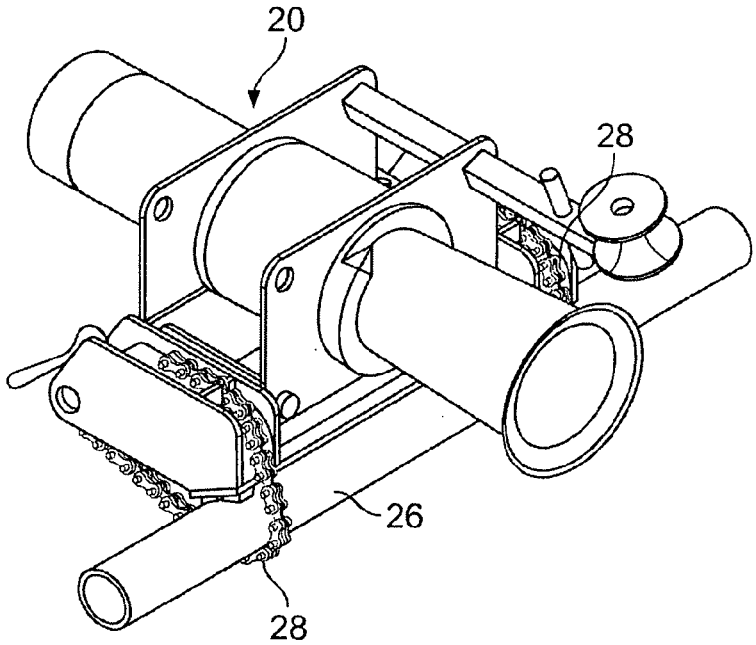
FIG. 2 (Prior Art)
Figure 3:
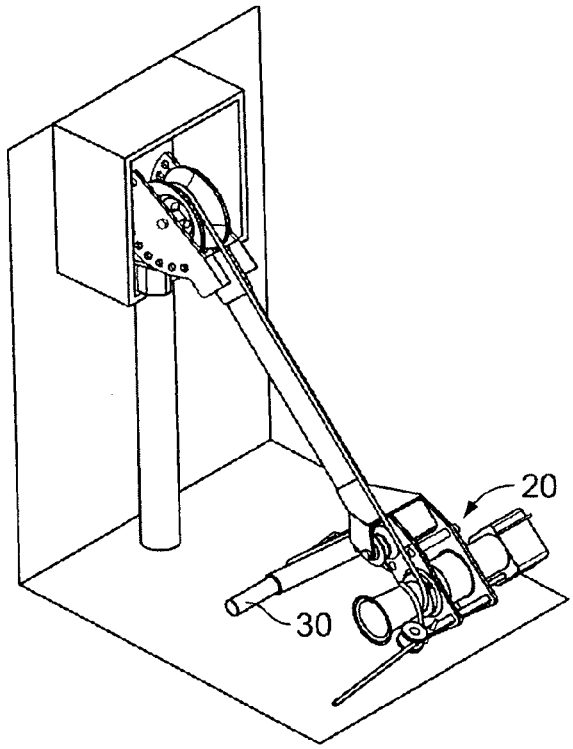
FIG. 3 (Prior Art)

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 7:
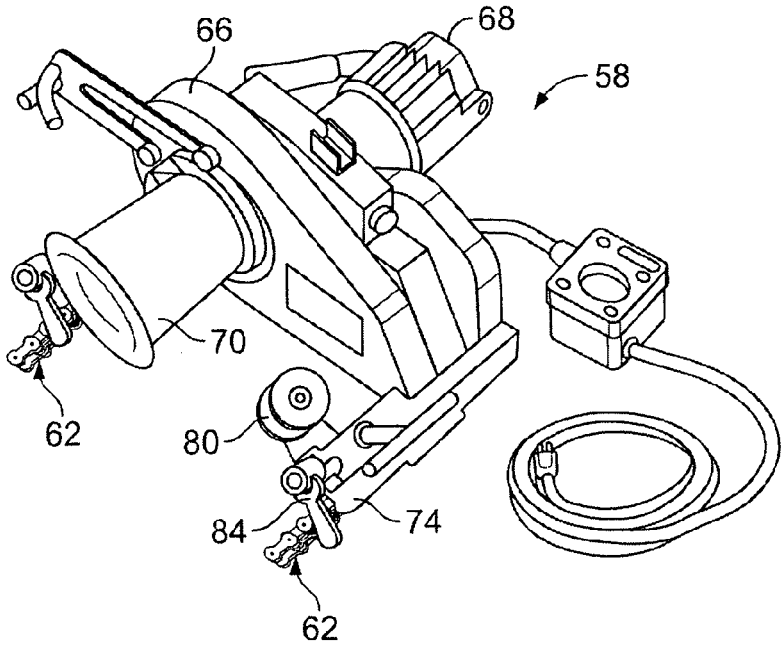
FIG. 7 (Prior Art)
FIG. 7 is a perspective view of another type of prior art cable puller.
Figure 8:
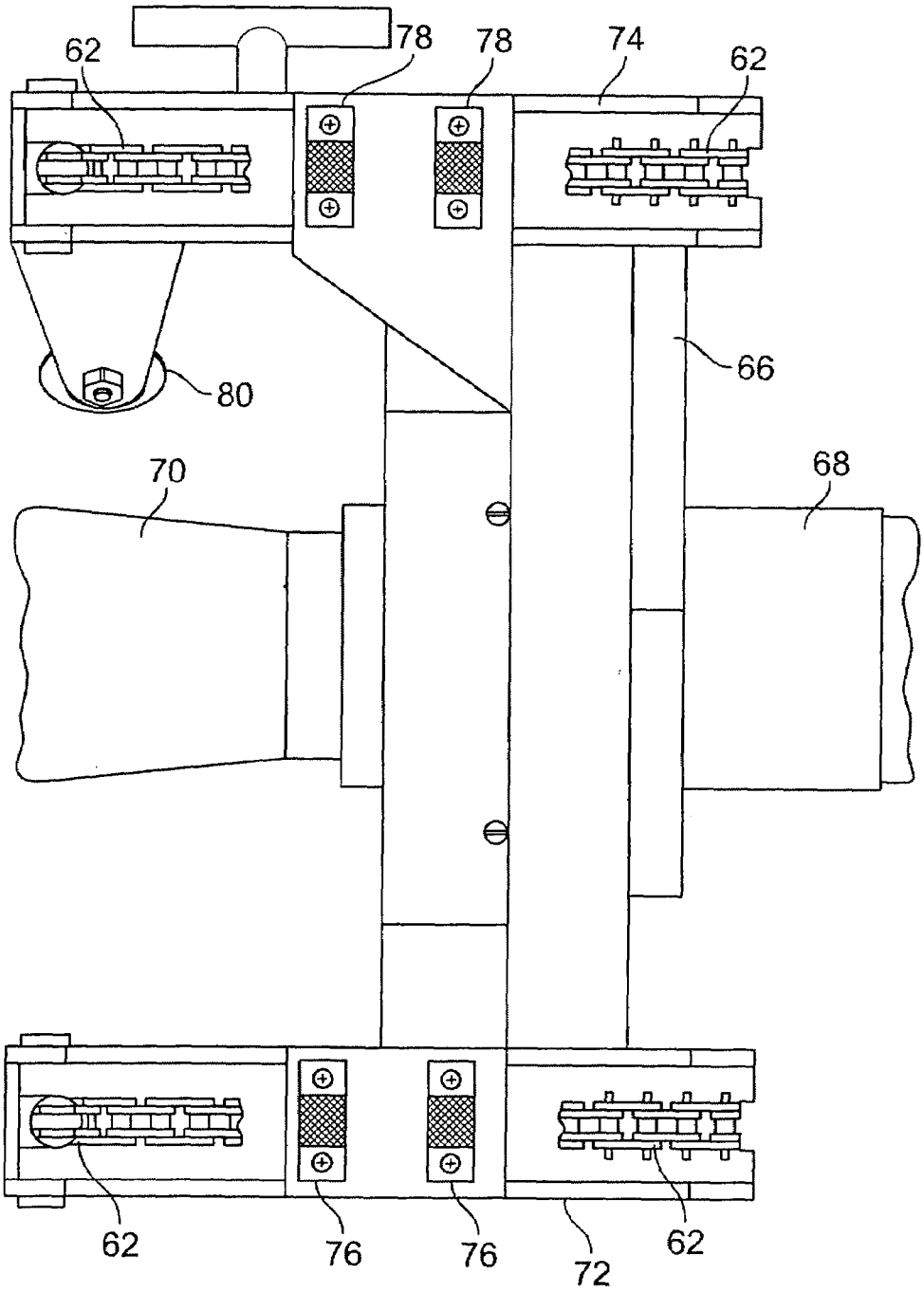
FIG. 8 (Prior Art)
FIG. 8 is a bottom plan view of the prior art cable puller shown in FIG. 7.

The present invention provides an adapter 100 for mounting on a prior art wheeled carriage 32 which enables a prior art cable puller 58, namely the Greenlee Textron, Inc. 640-Series cable puller or the 6000-Series cable puller shown in FIGS. 7 and 8, to be mounted on the wheeled carriage 32 by using the vise chains 62 provided on the prior art cable puller 58. As a result, an operator can easily move the cable puller 58 around the building in which the cable puller 58 is being used.

Attention is invited to FIGS. 12–17 which show a cable pulling system 102 in accordance with the present invention. The cable pulling system includes the cable puller 58, the wheeled carriage 32, the adapter 100, a boom tube 56 and a nose unit 57. The boom tube 56 has an end mounted on the adapter 100 and the nose unit 57 is mounted on the opposite end of the boom tube 56.

Figure 4:
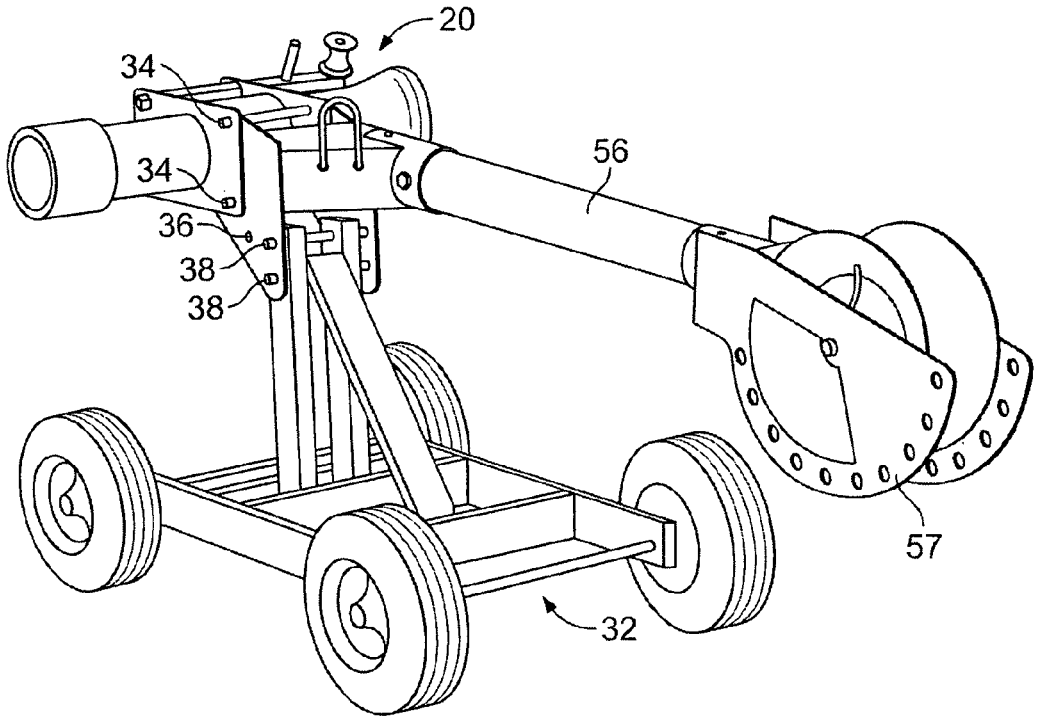
FIG. 4 (Prior Art)
Figure 5:
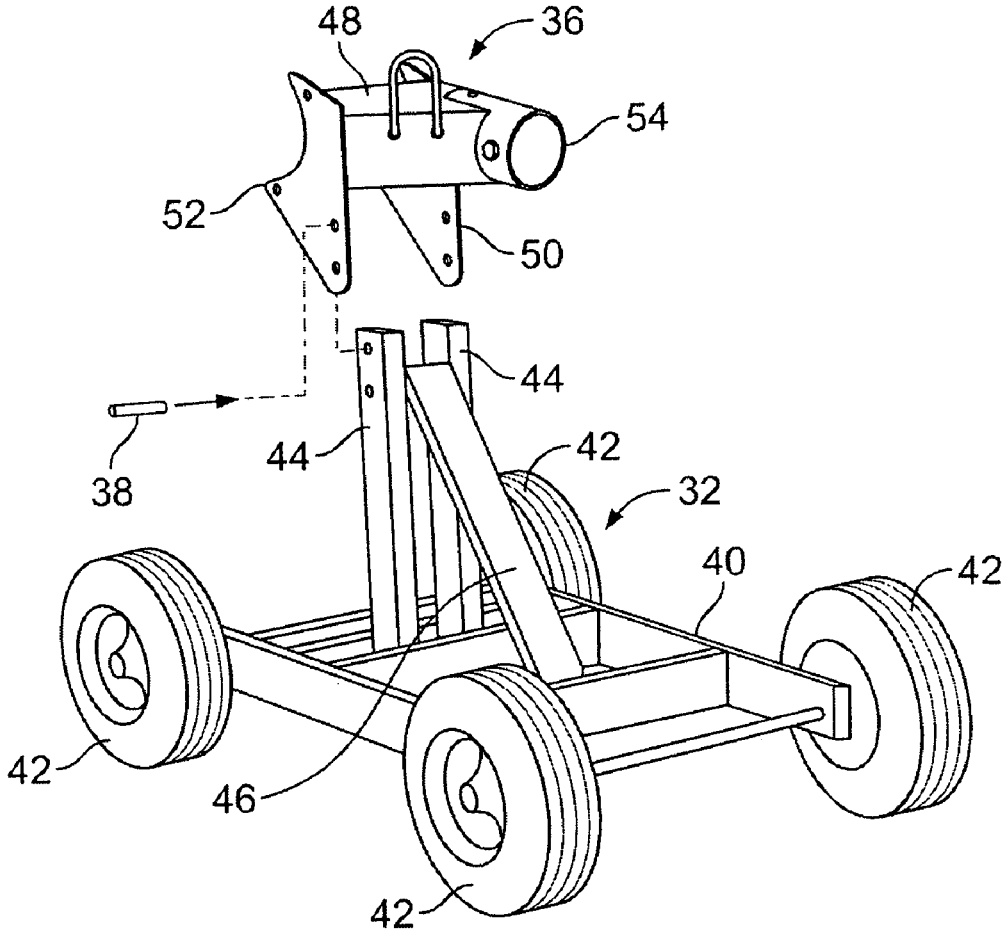
FIG. 5 (Prior Art)
FIGS. 5 and 6 are perspective views of one of the prior art mounting systems being assembled.
Figure 6:
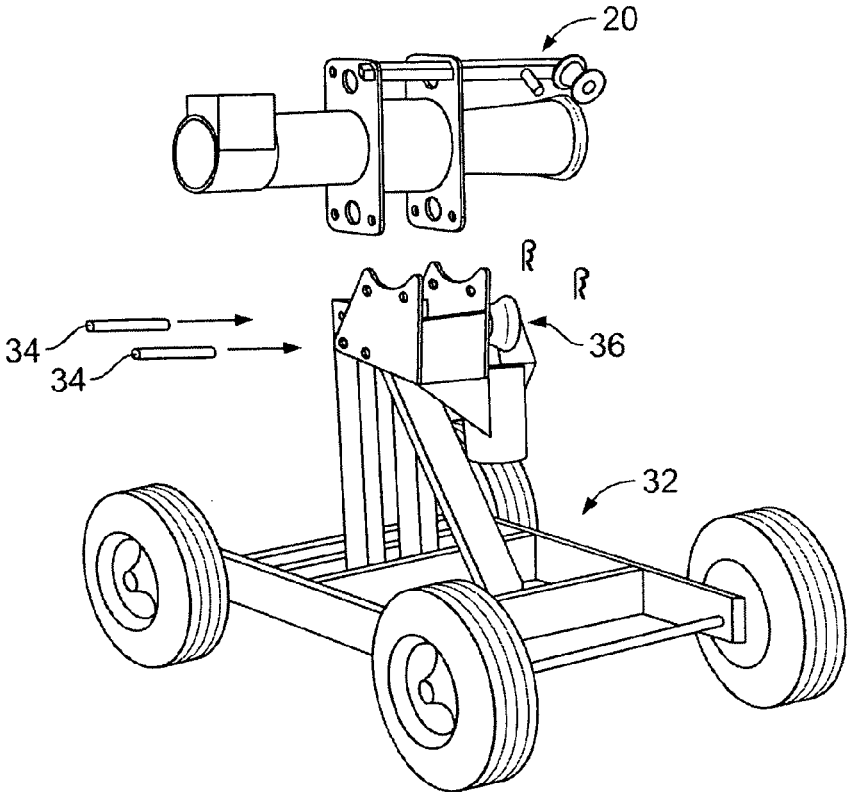
FIG. 6 (Prior Art)

The wheeled carriage 32 is formed in accordance with the prior art wheeled carriage 32 shown in FIGS. 4–6. The wheeled carriage 32 is formed from a horizontal frame 40 onto which wheels 42 are rotatably mounted by suitable means. A pair of spaced apart, upright posts 44 extend upwardly from the frame 40. A brace 46 extends upwardly from the frame 40 and connects between the posts 44. The brace 46 extends angularly from the frame 40.

Figure 13:
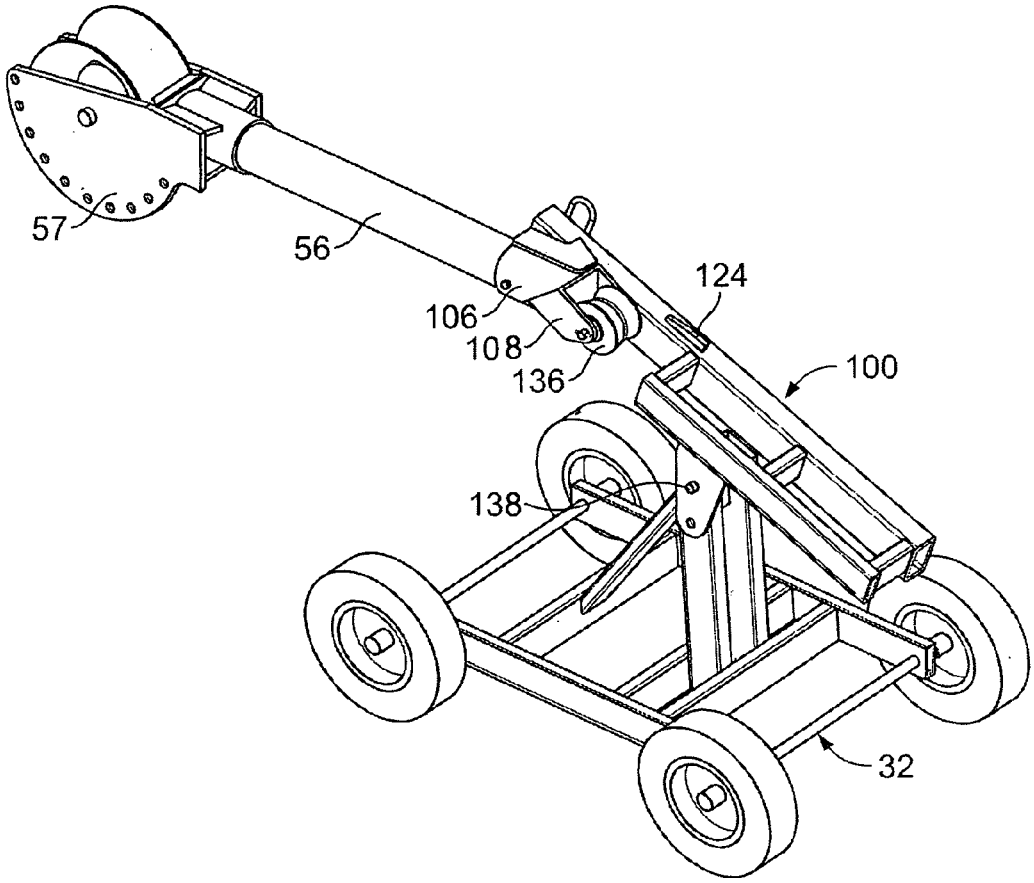
FIG. 13 is a perspective view of the cable pulling system of FIG. 12 with the cable puller removed therefrom.
Figure 14:
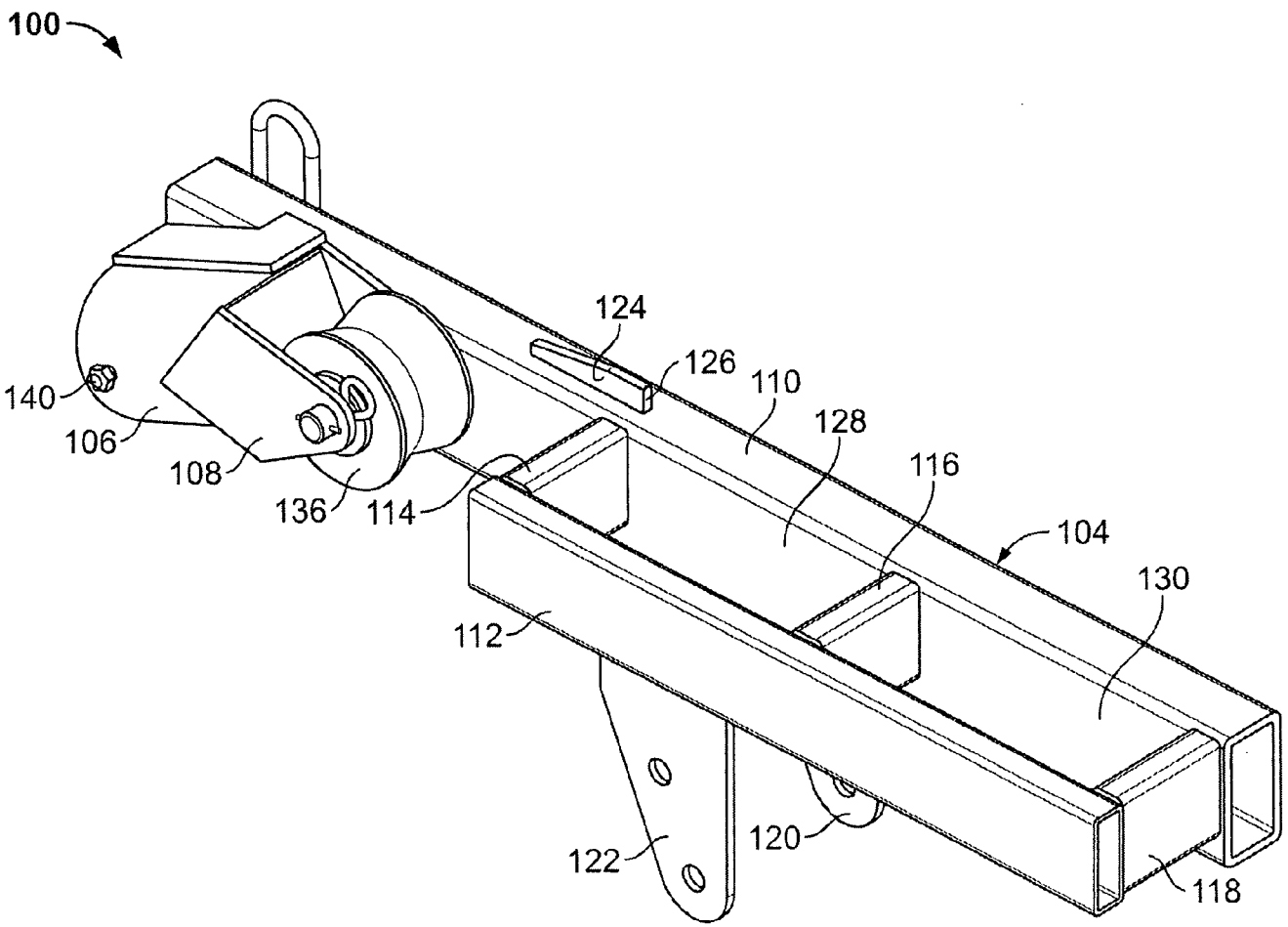
FIG. 14 is a perspective view of an adapter which forms a portion of the cable pulling system of the present invention from a rearward perspective.
Figure 15:
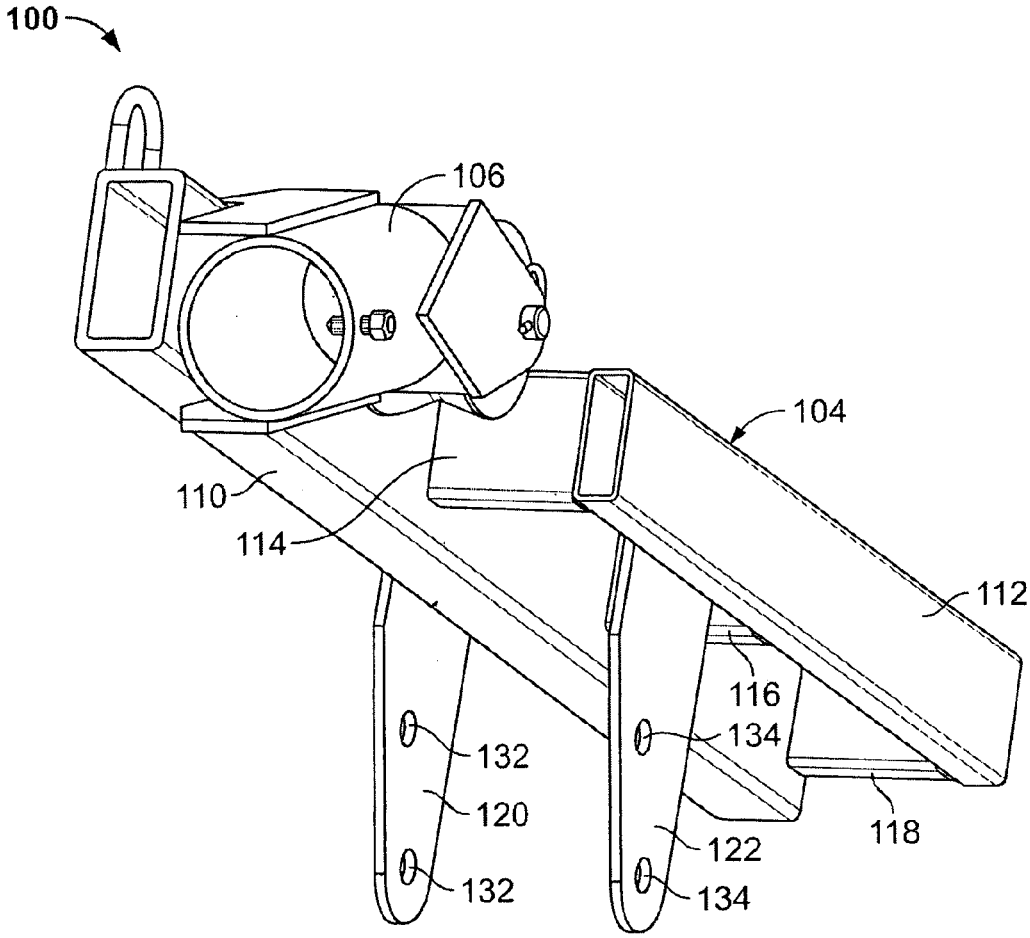
FIG. 15 is a perspective view of the adapter from a forward perspective.

The adapter 100 of the present invention is best shown in FIGS. 13–15. The adapter 100 is preferably formed of metal and the components of the adapter 100 described herein are preferably welded together. The adapter 100 is formed from a frame 104 having a boom receptacle 106 attached thereto and an idler roller mount 108 attached thereto. The boom receptacle 106 and the idler roller mount 108 are preferably welded to the frame 104. The frame 104 is formed from first and second elongated spars 110, 112, a plurality of spaced apart ribs 114, 116, 118 and a pair of legs 120, 122 which depend downwardly from the spars 110, 112.

The first and second elongated spars 110, 112 are spaced apart from each other by the ribs 114, 116. Each spar 110, 112 has a front end and a rear end is formed from a tube. The rear ends of the spars 110, 112 are substantially aligned. The front end of the first spar 110 extends outwardly from the front end of the second spar 112 a predetermined distance. A stop 124 extends outwardly from the first spar 110. The stop 124 starts at the first rib 114 and extends forwardly a predetermined distance. At the rear end of the stop 124, a surface 126 is provided and is perpendicular to the first spar 112.

A first rib 114 is provided between the spars 110, 112 at the front end of the second spar 112, a second rib 116 is provided between the spars 110, 112 at approximately the midpoint of the second spar 112, and a third rib 118 is provided between the spars 110, 112 at the rear of the first and second spars 110, 112. A front window 128 is formed and bounded by the first rib 114, the first spar 110, the second rib 116 and the second spar 112. A second window 128 is formed and bounded by the second rib 116, the first spar 110, the third rib 118 and the second spar 112.

As described herein, the cable puller 58 is mounted such that the housing 66 of the cable puller 58 sits on top of the spars 110, 112 and the ribs 114, 116, 118. The tops of the spars 110, 112 and the ribs 114, 116, 118 form a flat surface on which the cable puller 58 sits to provide stability to the cable puller 58.

A first leg 120 depends perpendicularly downward from the first spar 110 and is provided at approximately the midpoint of the second spar 112. A pair of spaced apart apertures 132 are provided in the first leg 120 and the apertures 132 are aligned vertically. A second leg 122 depends perpendicularly downward from the second spar 112 and is aligned with the first leg 120. A pair of spaced apart apertures 134 are provided in the second leg 122 and the apertures 134 are aligned vertically. The apertures 132 in the first leg 120 are horizontally aligned with the apertures 134 in the second leg 122.

The boom receptacle 106, which is formed as a tube, is affixed to the front end of the first spar 110 on the same side as the ribs 114, 116, 118 by suitable means, such as welding. An aperture is provided through the boom receptacle 106 at a position spaced from the front open end thereof. A generally U-shaped idler roller mount 108 which is formed of metal is mounted by suitable means, such as welding, to a rear end of the boom receptacle 106. The generally U-shaped idler roller mount 108 includes a base and first leg which extends from proximate a first end of the base and a second leg which extends from a second end of the base. The base closes the rear end of the boom receptacle 106. An aperture is provided through each leg and the apertures are aligned with each other. An idler wheel 136 is mounted between the first and second legs by a shaft which extends through the apertures. The shaft is secured to the first and second legs by suitable means, such as a cotter pin extending through an aperture provided through the shaft.

The adapter 100 is secured to the wheeled carriage 32 by a pin 138 which mount through the apertures 132, 134 in the first and second legs 120, 122 and in the posts 44. The boom tube 56 is secured to the boom receptacle 106 by a set screw 140 which extends through the aperture in the boom receptacle 106.

Figure 12:
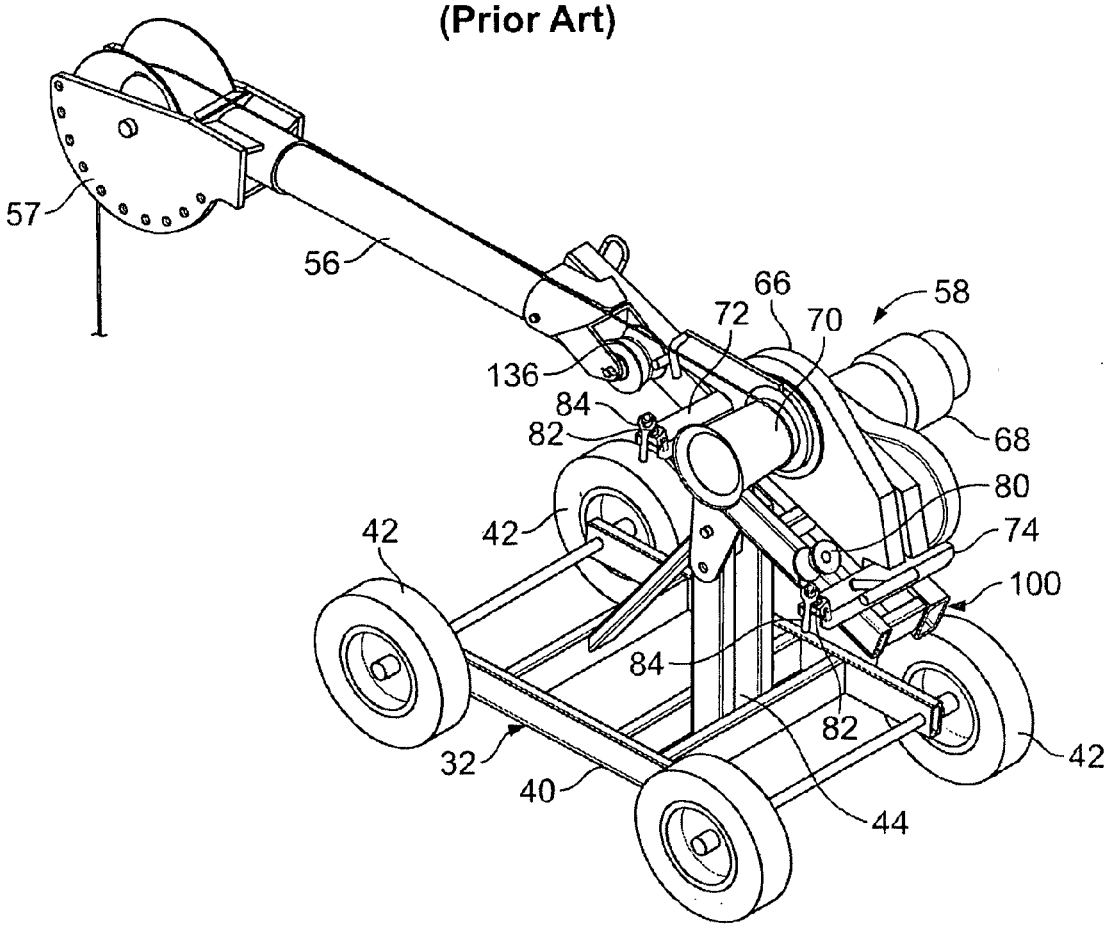
FIG. 12 is a perspective view of a cable pulling system which incorporates the features of the invention.
Figure 16:
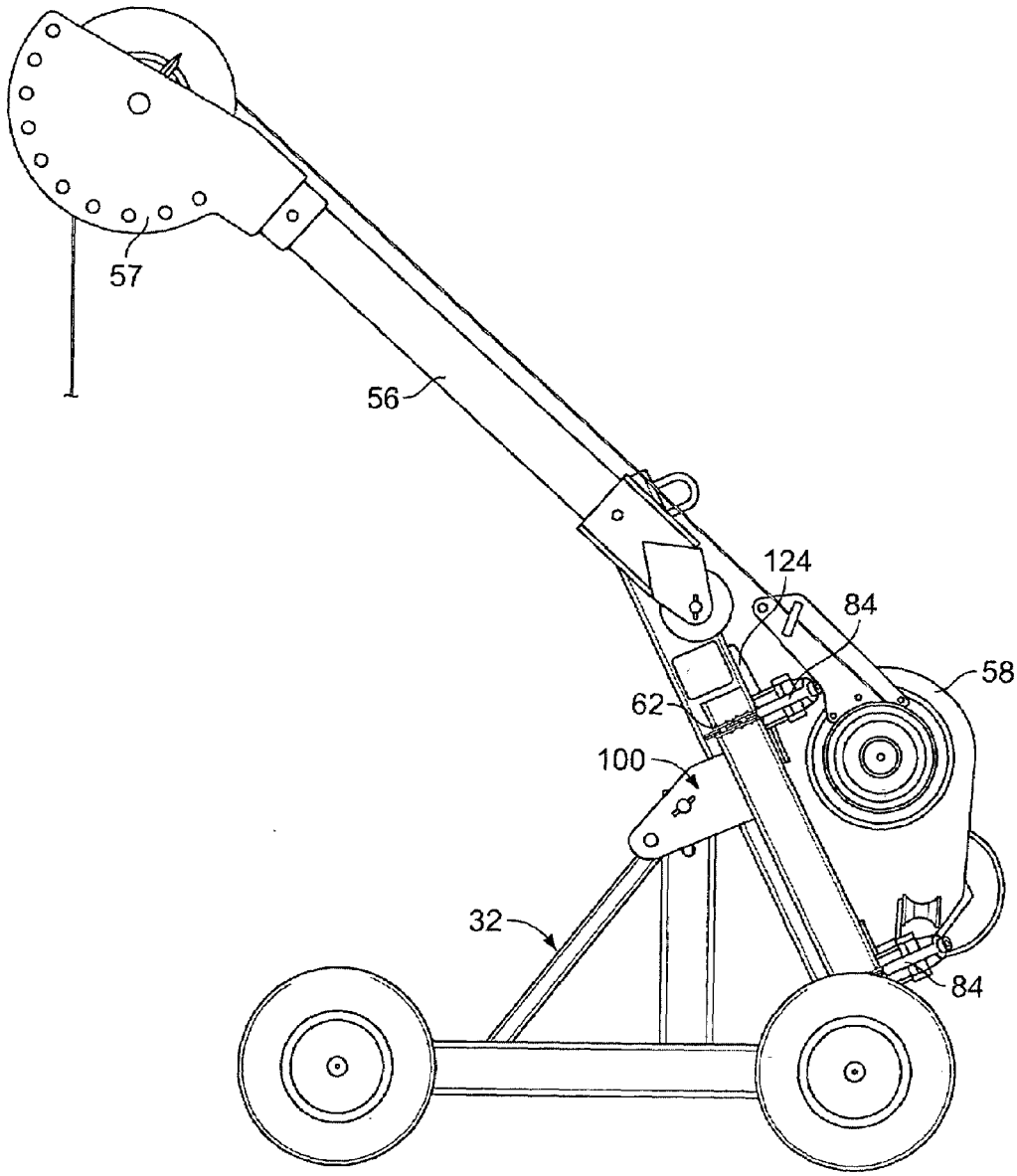
Figure 17:
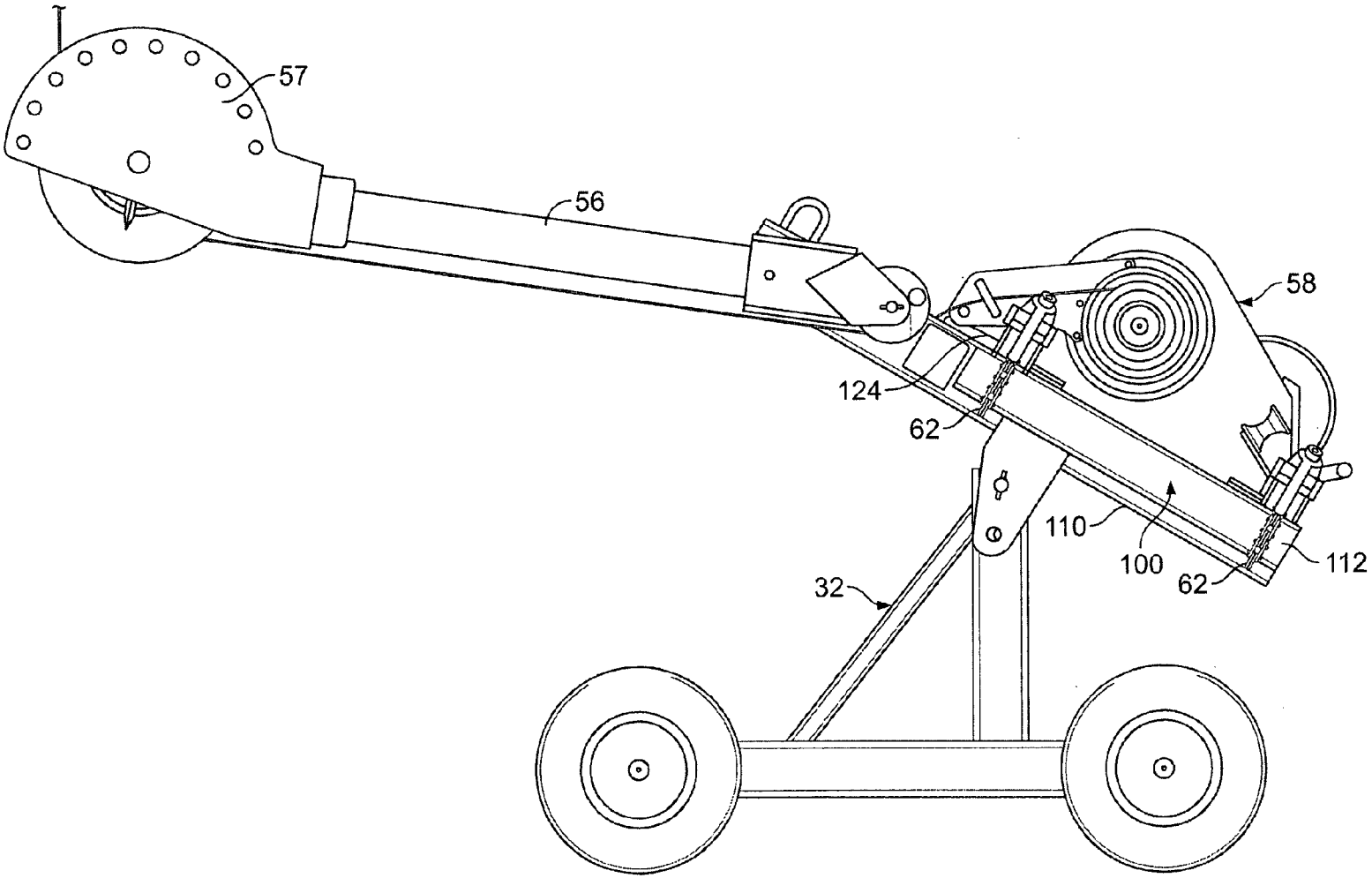

The cable puller 58 is formed in accordance with the prior art and may be, for example, the Greenlee Textron, Inc. 640-Series cable puller or the 6000-Series cable puller. The Greenlee Textron, Inc. 6000-Series cable puller is shown in FIGS. 12, 16 and 17.

Figure 9:
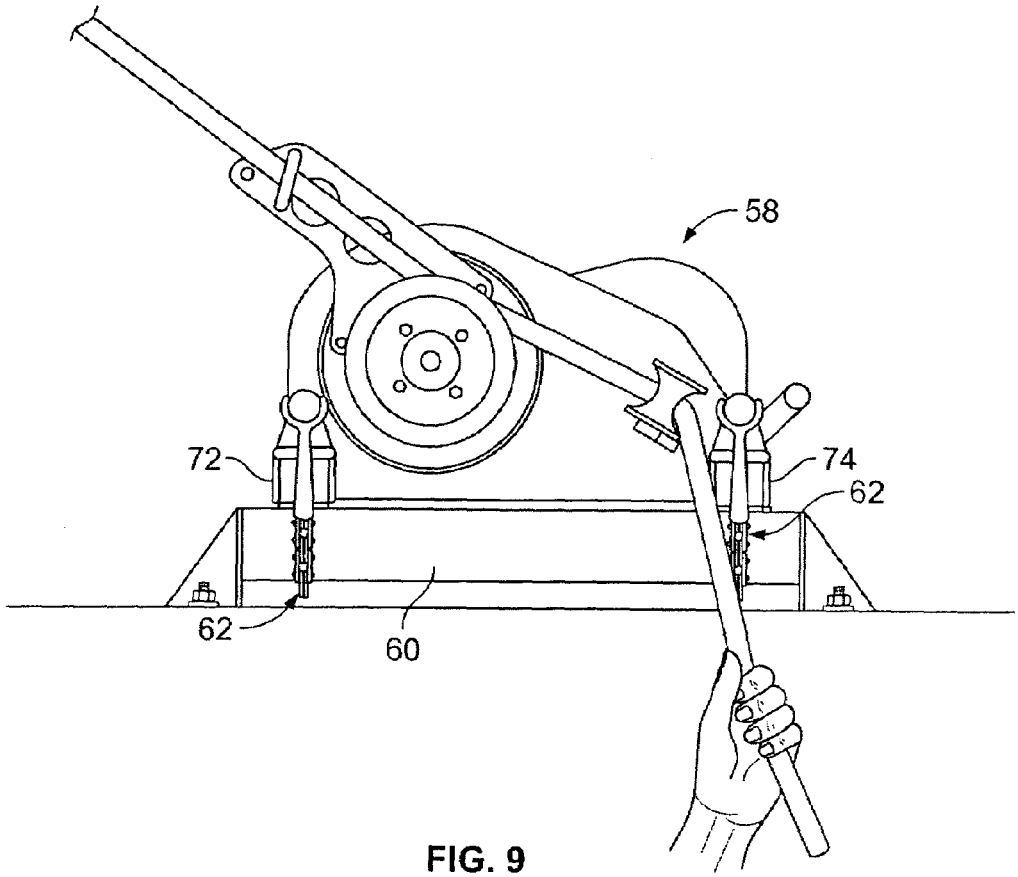
FIG. 9 (Prior Art)
FIG. 9 is a side elevational view of the prior art cable puller shown in FIG. 8 mounted on a prior art mounting system.
Figure 10:
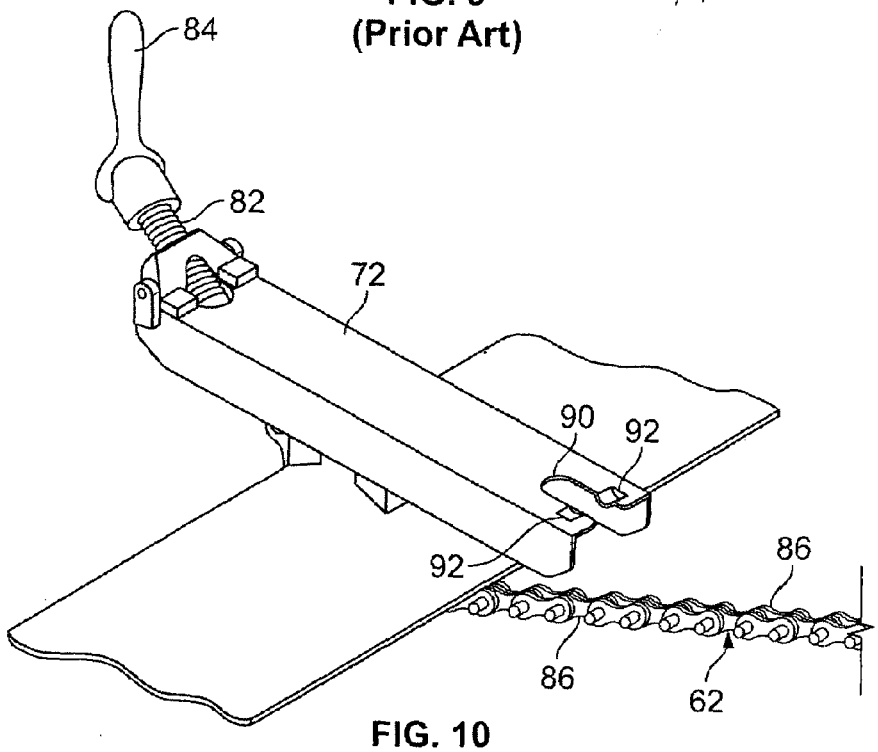
FIG. 10 (Prior Art)
FIGS. 10 and 11 are perspective views of portions of the mounting system of FIG. 8 being assembled.
Figure 11:
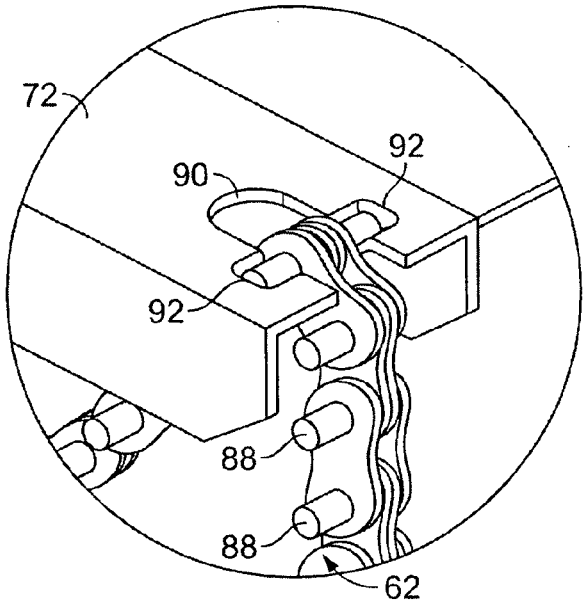
FIG. 11 (Prior Art)

Some cable pullers 58, such as the Greenlee Textron, Inc. 640-Series cable puller and the 6000-Series cable puller, do not have the ability to be pin-mounted to a wheeled carriage. The Greenlee Textron, Inc. 6000-Series cable puller is shown in FIGS. 7 and 8. The 6000-Series cable puller 58 is mounted to a pipe, conduit or adapter 60 by vise chains 62 which are provided as part of the 6000-Series cable puller 58 as shown in FIGS. 9–11.

The 6000-Series cable puller 58 includes a housing 66, a motor 68 mounted to a first side of the housing 66 and a capstan 70 which extends from a second side of the housing 66. The housing 66 houses the components of the motor 68 that connect the motor 68 and the capstan 70 together such that the motor 68 rotates the capstan 70. A front base 72 is mounted on the underside of the front end of the housing 66 and extends outwardly from the housing 66 on both sides thereof. A rear base 74 is mounted on the underside of the rear end of the housing 66 and extends outwardly from the housing on both sides thereof. A first pair of spaced apart gripping feet 76 extend from an underside of the housing 66 and are aligned with the front base 72. A second pair of spaced apart gripping feet 78 extend from an underside of the housing 66 and are aligned with the rear base 74. An idler roller 80 is rotatably mounted on the rear base 74 rearwardly of the capstan 70 by suitable means. Each base 72, 74 has a threaded member 82 mounted on an end thereof which extends through an associated threaded aperture in the respective base 72, 74. Each vise chain 62 is attached to an end of the respective threaded member 82 on the underside of the respective base 72, 74. A handle 84 is attached to the other end of the threaded member 82. The vise chain 62 is formed from a plurality of links 86. Each link 86 has a pair of chain pins 88 which extend outwardly from each side of the link 86. The other end of each base 72, 74 has a cutout 90 therein into which the link 86 can be positioned. The cutout 90 has a pair of pockets 92 on either side thereof which accepts the pins 88 provided on the link 86 when the link 86 is mounted therein.

To mount the cable puller 58 to the adapter 100, the housing 66 sits on top of the spars 10, 112 and the ribs 114, 116, 118, the front gripping feet 78 are placed within the front window 128 in the adapter 100 and the rear gripping feet 80 are placed within the rear window 130 in the adapter 100. The front gripping feet 78 are spaced apart from each other such that the distance is less than the width of the front window 128. The rear gripping feet 80 are spaced apart from each other such that the distance is less than the width of the rear window 130. In addition, the front gripping feet 78 are spaced from the rear gripping feet 80 such that the distance is less than the distance between the first rib 114 and the third rib 118. As a result, the engagement of the front gripping feet 78 and the rear gripping feet 80 within the respective windows 128, 130 ensures that the cable puller 58 is properly mounted on the adapter 100. The front wall of the housing 66 bears against the surface 126 of the stop 124. As such, the cable puller 58 is easily and accurately mounted onto the adapter 100.

The handles 84 are rotated to expose most of the threads which connects the handle 84 to the housing 66 of the cable puller 58. The vise chains 62 are wrapped around the adapter 100 such that the vise chains 62 contact the underside of the spars 110, 112; the vise chains 62 are pulled tight against the spars 110, 112; and the chain pins 88 are inserted into the pockets 92. Thereafter, the handles 84 are turned, by hand, to fully tighten the vise chains 62 against the adapter 100.

The 640-Series cable puller is mounted to the adapter in the same manner as the 6000-Series cable puller.

In use, the stop 124 prevents the cable puller 58 from sliding forward on the adapter 100 as cable is being pulled. As a result, the cable puller 58 is not solely retained by the friction created by the vise chains 62.

As in the prior art, the wheeled carriage 32 only bears weight and the boom tube 56 tolerates all force from the cable pull and prevents forward and backward movement.

As can be seen in the drawings, the cable puller 58 is mounted on the rear end of the adapter 100. When used to pull cable, a rope is attached to the cable pulling system 102 by inserting an end of the rope through the nose unit 57, over or under the idler roller 136 depending on the application, around the capstan 70 and around the idler roller 80. The distance between the boom tube 56 and the rope is designed to be as small as possible to minimize bending moment of the boom tube 56. In addition, the rope is centered on the boom tube 56 to minimize the moment arm and prevent bending of the boom tube 56. The boom receptacle 106 on the adapter 100 is at a predetermined angle and distance from the mounting surface on the adapter 100 for the cable puller 58 that the rope passes parallel and very close to the boom tube 56 to minimize stress on the boom tube 56.

The rope can be easily inserted into the cable pulling system 102 by running the rope over or under the boom tube 56 by side loading. This eliminates any threading of the rope through the cable pulling system. When a downward pull is made, the adapter 100 allows the rope to pass up from underneath the boom tube 56 to the capstan 70 without requiring the rope to be threaded through any openings.

The adapter 100 can be pivoted on the wheeled carriage 32 to accommodate a variety of desired pulling configurations to suit the operating environment. The adapter 100 pivots around the pin 138. The cable pulling system 102 can be locked into a horizontal position for transportation and can be locked into a variety of positions for use.

While a preferred embodiment of the present invention is shown and described, it is envisioned that those skilled in the art may devise various modifications of the present invention without departing from the spirit and scope of the appended claims.

The invention claimed is:

1. An assembly comprising:

a cable puller having a housing and a plurality of feet which extend downwardly from an underside of said housing, said cable puller having vise chains attached thereto;

a wheeled carriage; and an adapter mounted on said wheeled carriage, said adapter having a frame onto which said cable puller is mounted by said vise chains, said frame having a flat surface onto which said cable puller is mounted, said frame being formed first and second spars and at least one rib which spaces said spars apart from each other, and at least one window formed within said frame, said feet of said cable puller being inserted into said at least one window.

2. An assembly comprising:

a cable puller, said cable puller having vise chains attached thereto;

a wheeled carriage; and an adapter mounted on said wheeled carriage, said adapter having a frame onto which said cable puller is mounted by said vise chains, said flame having a flat surface onto which said cable puller is mounted, said frame being formed from first and second spars and at least one rib which spaces said spars apart from each other, and a stop which extends outwardly from said frame, a front of said housing of said cable puller abutting against said stop.

3. An assembly comprising:

a cable puller, said cable puller having vise chains attached thereto;

a wheeled carriage; and an adapter mounted on said wheeled carriage, said adapter having a frame onto which said cable puller is mounted by said vise chains, said frame having a flat surface onto which said cable puller is mounted, said frame being formed from first and second spars and at least one rib which spaces said spars apart from each other, and a boom receptacle mounted to said frame, an idler roller mount mounted to said frame and an idler roller attached to said idler roller mount.

4. An assembly comprising:

a cable puller having a housing and a plurality of feet which extend downwardly from an underside of said housing, and said cable puller having vise chains attached thereto;

a wheeled carriage; and an adapter mounted on said wheeled carriage, said adapter having a frame onto which said cable puller is mounted by said vise chains, and said frame is formed from first and second spars and at least one rib which spaces said spars apart from each other, said cable puller abutting said spars and said at least one rib, and at least one window is formed within said frame, said feet of said cable puller being inserted into said at least one window.

5. An assembly comprising:

a cable puller, said cable puller having vise chains attached thereto;

a wheeled carriage; and an adapter mounted on said wheeled carriage, said adapter having a frame onto which said cable puller is mounted by said vise chains, and said frame is formed from first and second spars and said at least one rib which spaces said spars apart from each other, said cable puller abutting said spars and said at least one rib, and a stop which extends outwardly from said frame, a front of said housing of said cable puller abutting against said stop.

6. An assembly comprising:

a cable puller, said cable puller having vise chains attached thereto;

a wheeled carriage; and an adapter mounted on said wheeled carriage, said adapter having a frame onto which said cable puller is mounted by said vise chains, and said frame is formed from first and second spars and at least one rib which spaces said spars apart from each other, said cable puller abutting said spars and said at least one rib, and a boom receptacle mounted to said frame, an idler roller mount mounted to said frame and an idler roller attached to said idler roller mount.

7. An assembly comprising:

a cable puller having a housing and a plurality of feet which extend downwardly from an underside of said housing, said cable puller having vise chains attached thereto;

a wheeled carriage; and an adapter rotatably mounted to said wheeled carriage, said adapter having a frame onto which said cable puller is mounted by said vise chains, said frame being formed from first and second spars and at least one rib which spaces said spars apart from each other, and at least one window formed within said frame, said feet of said cable puller being inserted into said at least one window.

8. An assembly comprising:

a cable puller, said cable puller having vise chains attached thereto;

a wheeled carriage; and an adapter rotatably mounted to said wheeled carriage, said adapter having a frame onto which said cable puller is mounted by said vise chains, said frame being formed from first and second spars and at least one rib which spaces said spars apart from each other and a stop which extends outwardly from said frame, a front of said housing of said cable puller abutting against said stop.

9. An assembly comprising:

a cable puller, said cable puller having vise chains attached thereto;

a wheeled carriage; and an adapter rotatably mounted to said wheeled carriage, said adapter having a frame onto which said cable puller is mounted by said vise chains, said frame being formed from first and second spars and at least one rib which spaces said spars apart from each other, and a boom receptacle mounted to said frame, an idler roller mount mounted to said frame and an idler roller attached to said idler roller mount.

10. An assembly as defined in claim 9, further including a boom tube attached to said boom receptacle and a nose unit attached to said boom tube.

* * * * *